US007429995B2

(12) United States Patent
Sato et al.

(10) Patent No.: US 7,429,995 B2
(45) Date of Patent: Sep. 30, 2008

(54) IMAGE FORMING APPARATUS

(75) Inventors: Keiichiro Sato, Ebina (JP); Kenji Hara, Ebina (JP); Yumiko Onuma, Ebina (JP); Yoshiaki Tainaka, Ebina (JP); Seiji Taira, Ebina (JP); Noriyuki Miyoshi, Ebina (JP); Keita Yano, Ebina (JP); Masakatsu Eda, Ebina (JP); Tomofumi Suzuki, Ebina (JP); Keiji Miba, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 11/136,443

(22) Filed: May 25, 2005

(65) Prior Publication Data

US 2006/0092259 A1 May 4, 2006

(30) Foreign Application Priority Data

Nov. 4, 2004 (JP) ..... 2004-320993

(51) Int. Cl.
*G03G 15/20* (2006.01)

(52) U.S. Cl. ..... 347/156; 399/323

(58) Field of Classification Search ..... 399/323; 347/156

See application file for complete search history.

(56) References Cited

U.S. PATENT DOCUMENTS 5,517,292 A * 5/1996 Yajima et al. ..... 399/323
6,658,229 B2 * 12/2003 Ando et al. ..... 399/323
2004/0146322 A1 * 7/2004 Lee ..... 399/323
2006/0133864 A1 * 6/2006 Tatematsu et al. ..... 399/320

FOREIGN PATENT DOCUMENTS

JP 2003-195668 7/2003
JP 2004-233405 8/2004

* cited by examiner

*Primary Examiner*—Huan Tran
(74) *Attorney, Agent, or Firm*—Morgan, Lewis & Bockius LLP

(57) ABSTRACT

An image forming apparatus includes a recording material transporting path that extends in a direction from below upward and that transports a recording material, a fixing device provided on the way of the recording material transporting path, the fixing device having a rotatable heating member that has a heating source provided inside thereof and a rotatable pressure member that forms a fixing nip in pressure contact with the heating member, and a detaching member that contacts the heating member in the vicinity at a downstream side of the of the fixing nip in the rotation direction of the heating member and detaches the recording material from the heating member. The detachment member has a detachment guide surface extending from a contact point with the heating member, and a tilt of the detachment guide surface toward the pressure member side in relation with a vertical line including the contact point is not more than 2.5°.

10 Claims, 8 Drawing Sheets

FIG. 8

| γ (°) | -4.0 | -3.5 | -3.0 | -2.5 | -2.0 | -1.5 | -1.0 | -0.0 | 1.0 |
|---|---|---|---|---|---|---|---|---|---|
| OCCURRENCE OF PAPER COCKLES | C | C | B | A | A | A | A | A | A |

A: NO PAPER COCKLE OCCUR
B: SLIGHT PAPER COCKLES OCCUR
C: PAPER COCKLES OCCUR

IMAGE FORMING APPARATUS

BACKGROUND OF THE INVENTION (1). Field of the Invention

The present invention relates to an image forming apparatus utilizing an electrophotographic system, for example, and specifically, to an image forming apparatus that performs image formation while transporting recording materials substantially in a vertical direction.

(2). Description of the Related Art

In an image forming apparatus such as a copier and printer utilizing an electrophotographic system, for example, a photoconductor of a drum shape (photoconductor drum) is uniformly charged, the photoconductor drum is exposed to light controlled based on image information, and an electrostatic latent image is formed on the photoconductor drum. Then, the electrostatic latent image is turned into a visible image (toner image) with toner, and the toner image is transferred from the photoconductor drum to a recording material in a transfer part, and the toner image is fixed onto the recording material by a fixing device.

As the fixing device used for such an image forming apparatus, generally, a device including a fixing roll formed by laminating a heat-resistant elastic material layer and a release layer on a cylindrical core provided with a heating source therein and a pressure roll formed by laminating a heat-resistant elastic material layer and a release layer composed of a heat-resistant resin coating or heat-resistant rubber coating on a core in pressure contact with each other is used. In this configuration, a recording material carrying an unfixed toner image is passed through between the rotating fixing roll and pressure roll for heating and pressurizing the unfixed toner image, and thereby, the toner image is fixed onto the recording material.

For such an image forming apparatus, an arrangement in which the above fixing device is disposed above the photoconductor drum in a vertical direction, a transporting path for upwardly transporting substantially in the vertical direction a recording material fed from a paper tray disposed below the photoconductor drum in the vertical direction is formed, and thereby, a toner image on the photoconductor drum is transferred onto the recording material by a transfer member disposed along the transporting path and the recording material is transported to the fixing device has been known.

The image forming apparatus having such an arrangement requires only a very short transporting path for transporting the recording material, and further, a large part of the transporting path can be exposed only by opening one side surface of the image forming apparatus. Accordingly, output time from feeding paper to ejecting paper can be shortened and the transportation of the recording material can be improved, and further, removal of the recording material when a paper jam occurs is easy. Furthermore, the installation area of the image forming apparatus can be easily designed smaller.

However, in the image forming apparatus in which the recording material is transported upwardly substantially in the vertical direction (vertically transported), since the fixing device is provided in a position where the recording material is transported from below upward against gravitational force, when the recording material after fixing in the fixing device is transported, the direction of gravitational force acting on the recording material ejected from the fixing device is substantially on the same line as the transporting direction of the recording material but opposite in direction. Accordingly, unlike a conventional image forming apparatus in which a recording material is transported in a horizontal direction, in the vertically transporting image forming apparatus, it is configurationally difficult to stably support the recording material during transporting utilizing gravitational force, and the behavior of the recording material is likely to be unstable. That is, since it is difficult to stably support the recording material in the horizontal direction with respect to the recording material transported upwardly substantially in the vertical direction by the rotating fixing roll and pressure roll in pressure contact with each other, the recording material becomes unstable in the horizontal direction. Accordingly, the traveling directions of the recording materials are not determined in a certain direction, and wavy wrinkles (so-called "paper cockles") in the traveling direction become easier to occur in the recording materials. In addition, the recording material becomes easier to come into contact with members around the transporting path, and, depending on the contact angle at that time, bending and folding of both lead edges of the recording material (so-called "dog-ears") may possibly occur.

SUMMARY OF THE INVENTION

The present invention has been made in view of the above circumstances and provides an image forming apparatus that a fixing device is provided in a position where the recording material is transported from below upward against gravitational force in order to suppress the occurrence of paper cockles and dog-ears in a recording material.

According to an aspect of the invention, an image forming apparatus includes a recording material transporting path that extends in a direction from below upward and that transports a recording material, a fixing device provided on the way of the recording material transporting path, the fixing device including a rotatable heating member that has a heating source provided inside thereof, and a rotatable pressure member that forms a fixing nip in pressure contact with the heating member, and a detaching member that contacts the heating member in the vicinity at a downstream side of the of the fixing nip in the rotation direction of the heating member and detaches the recording material from the heating member. The detachment member has a detachment guide surface extending from a contact point with the heating member, and a tilt of the detachment guide surface toward the pressure member side in relation with a vertical line including the contact point is not more than 2.5°

BRIEF DESCRIPTION OF THE DRAWINGS

Embodiments of the invention will be described in detail based on the following figures, wherein:

FIG. 8 shows the relationship between an angle γ formed by the detachment guide surface of the detachment claw and a vertical line at a contact point of the detachment claw and the fixing roll and occurrence of cockles in the paper P.

DETAILED DESCRIPTION OF THE INVENTION

Figure 1:
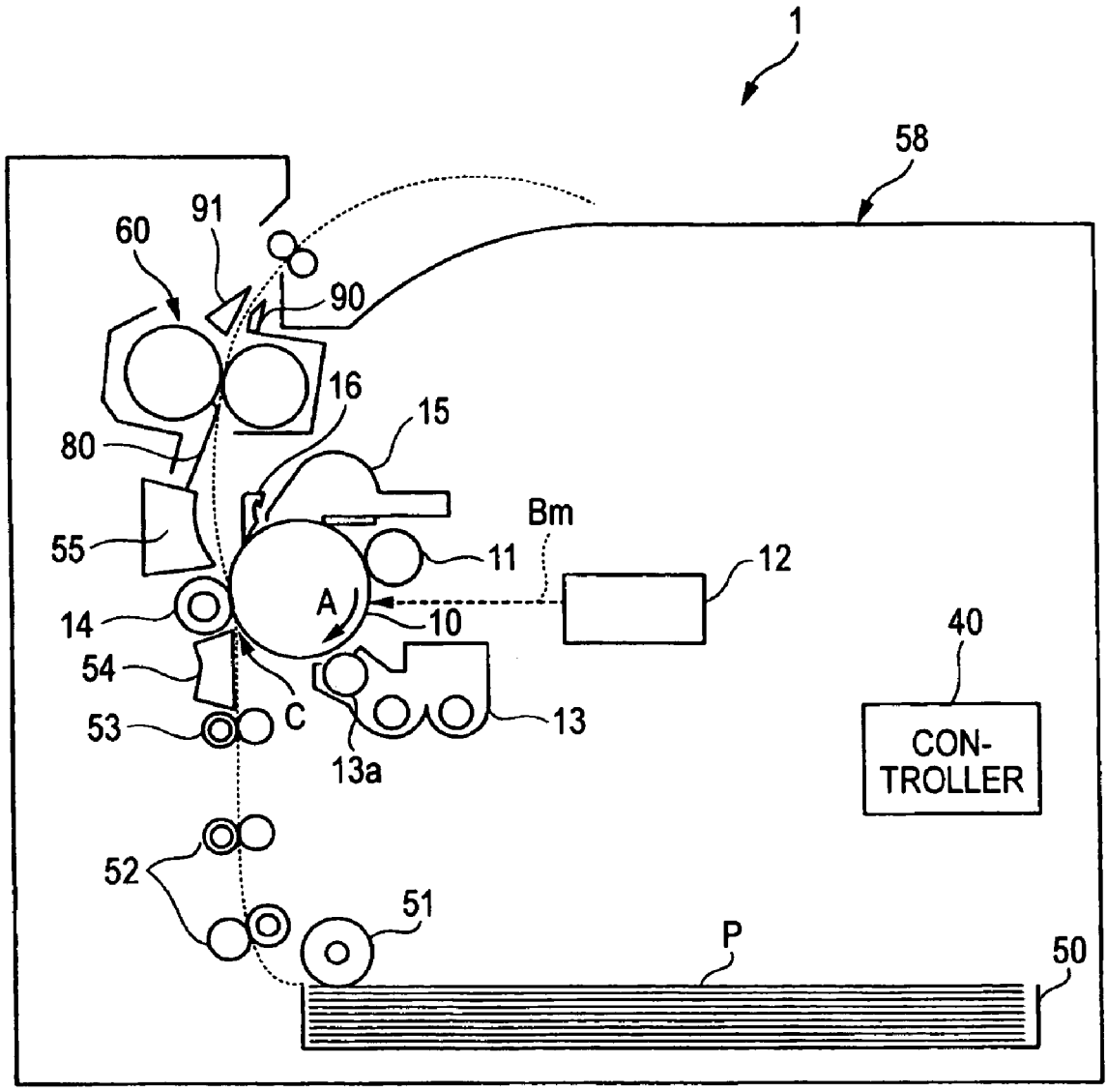
FIG. 1 is a schematic configurational diagram showing an image forming apparatus.

Hereinafter, an embodiment of the invention will be described in detail by referring to the drawings.

FIG. 1 is a schematic configurational diagram showing an image forming apparatus to which the embodiment is applied. An image forming apparatus 1 shown in FIG. 1 includes devices for an electrophotographic system disposed around a photoconductor drum 10 as an example of a toner image carrier rotating in a direction of an arrow A, such as a charger 11 for charging the photoconductor drum 10, a laser exposure unit 12 for writing an electrostatic latent image on the photoconductor drum 10 (an exposure beam is shown by the sign Bm in the drawing), a developing unit 13 accommodating toner for visualizing the electrostatic latent image on the photoconductor drum 10 with the toner, a transfer roll 14 as an example of a transfer unit for transferring the toner image formed on the photoconductor drum 10 onto paper P as a recording material, and a drum cleaner 15 for removing residual toner on the photoconductor drum 10. Further, a fixing unit 60 as a fixing unit for fixing unfixed toner image that has been transferred onto the paper P and a controller 40 for controlling operations of the respective devices (respective parts).

Further, in the image forming apparatus 1 of the embodiment, as a paper transporting system, a paper tray 50 that accommodates paper P, a pickup roll 51 that takes out the paper P stacked in the paper tray 50 with predetermined timing, a transporting roll 52 that transports the paper P brought out by the pickup roll 51, a registration roll 53 that feeds the paper P transported by the transporting roll 52 toward the transfer roll 14 with predetermined timing, an inlet chute 54 that guides the paper P fed from the registration roll 53 to a transfer nip C, a transportation guide 55 that transports the paper P after the transfer process is performed by the transfer roll 14 to the fixing unit 60, a fixing entry guide 80 that guides the paper P transported after transferred with the toner image to the fixing unit 60, and paper ejection guides 90 and 91 as paper ejection guiding members that guide the paper P ejected from the fixing unit 60 to an ejected paper receiving part 58.

Further, in the image forming apparatus 1 of the embodiment, the fixing unit 60 is disposed above relative to the photoconductor drum 10 in the vertical direction, and the paper tray 50 is arranged below the photoconductor drum 10 in the vertical direction. The paper P fed from the paper tray 50 is transported in the transporting path formed from below upward substantially in the vertical direction, and the toner image formed on the photoconductor drum 10 is transferred onto the paper P at the transfer nip C located along the transporting path, and further, the paper reaches the fixing unit 60 located above the transfer nip C and is subjected to fixing processing.

In the image forming apparatus 1 having such an arrangement, the transporting path for transporting the paper P is very short, and further, a large part of the transporting path can be easily exposed only by opening one side surface of the image forming apparatus 1. Accordingly, the output time from feeding paper to ejecting paper can be shortened and the transportation of the paper P can be improved, and further, it is easy to remove a jammed paper. Furthermore, the installation area of the image forming apparatus 1 can be easily designed smaller.

Next, a basic image forming process of the image forming apparatus 1 according to the embodiment will be described. In the image forming apparatus 1 shown in FIG. 1, predetermined image processing is performed by an image processing device (not shown) on image data output from an image reading device (not shown), a personal computer (not shown), or the like. In the image processing device, predetermined image processing of various kinds of image edition such as shading correction, displacement correction, gamma correction, edge erase, and movement edition is performed on input reflectance data. The image data that has been subjected to image processing is output to the laser exposure unit 12.

In the laser exposure unit 12, the exposure beam Bm output from a semiconductor laser, for example, is applied to the photoconductor drum 10 according to the input image data. In the photoconductor drum 10, after the surface is charged by the charger 11 of a charging roll to a predetermined charge potential (e.g., −750V), the surface is scan-exposed by the laser exposure unit 12 and an electrostatic latent image is formed thereon.

The formed electrostatic latent image is reversely developed by negatively charged toner by the developing unit 13. That is, a developing bias of a direct-current voltage or a developing bias formed by superimposing a direct-current voltage on an alternating voltage from a power supply (not shown) is applied to a developer carrier (developing sleeve) 13*a* that carries a developer in which toner, for example, produced by polymerization method and having a shape factor SF1 of 100 to 140 and carrier of magnetic particles are mixed, and a developing electric field is formed between the developing sleeve and the photoconductor drum 10. Thereby, the toner on the developing sleeve 13*a* is transferred to an image part (exposed part) of the electrostatic latent image, and the electrostatic latent image is visualized.

Then, when the toner image formed on the photoconductor drum 10 is carried to the transfer nip C where the photoconductor drum 10 and the transfer roll 14 are in contact with each other, in the paper transporting system, the pickup roll 51 rotates with the timing when the toner image is carried to the transfer nip C, and paper P in a predetermined size is supplied from the paper tray 50. The paper P supplied by the pickup roll 51 is transported by the transporting roll 52, and reaches the registration roll 53. At the registration roll 53, the paper P is once stopped, and the registration roll 53 rotates with the timing of movement of the photoconductor drum 10 carrying the toner image. Thereby, the position of the paper P and the position of the toner image are aligned, and the paper P is guided to the inlet chute 54 and fed out to the transfer nip C.

At the transfer nip C, the transfer roll 14 is in pressure contact with the photoconductor drum 10. The transfer roll 14 includes a shaft and a sponge layer as an elastic layer fixed to the circumference of the shaft. The shaft is a cylindrical bar formed by a metal such as iron or SUS. The sponge layer is a sponge-like cylindrical roll formed by blend rubber of NBR, SBR, and SPDM compounded with a conductive agent such as carbon black, for example and has volume resistivity of $10^7$ to $10^9$ Ωcm.

For example, a current under constant current control is supplied to the transfer roll 14 so that a transfer bias of the opposite polarity (positive polarity) to the toner charge polarity (negative polarity) may be stably applied from a transfer power supply (not shown). Thereby, charge of the opposite polarity to the charge polarity of the toner on the photoconductor drum 10 is applied from the transfer roll 14 to the paper P. Note that the transfer bias is set so that it may be applied only when the image area on the photoconductor drum 10 passes through the transfer nip C and it may not be applied when the inter-image area between the image areas passes through the transfer nip C.

Then, the paper P transported with timing is further transported to the transfer nip C and nipped between the photoconductor drum 10 and the transfer roll 14. At that time, the transfer bias is applied from the transfer roll 14, and the unfixed toner image carried on the photoconductor drum 10 is electrostatically transferred onto the paper P.

Then, the paper P on which the toner image has been electrostatically transferred, is detached from the photoconductor drum 10 because of electrostatic attraction force from the transfer roll 14 and rigidity of paper P and carried, and fed to the fixing unit 60 provided at the downstream side of the transfer 14 in the transporting direction of the paper P. In the case where the paper P is not detached from the photoconductor drum 10 and left attached to the photoconductor drum 10, the paper P will be detached from the photoconductor drum 10 by detachment claws 16 provided near the surface of the photoconductor drum 10 at the downstream side of the transfer nip C.

The unfixed toner image on the paper P that has been carried to the fixing unit 60 is fixed onto the paper P by being subjected to fixing processing with heat and pressure in the fixing unit 60. Then, the paper P on which the fixed image is formed is transported to the ejected paper receiving part 58 provided at the eject part of the image forming apparatus 1, and a series of image formation operations are completed.

Subsequently, the configuration of the fixing unit 60 will be described.

Figure 2:
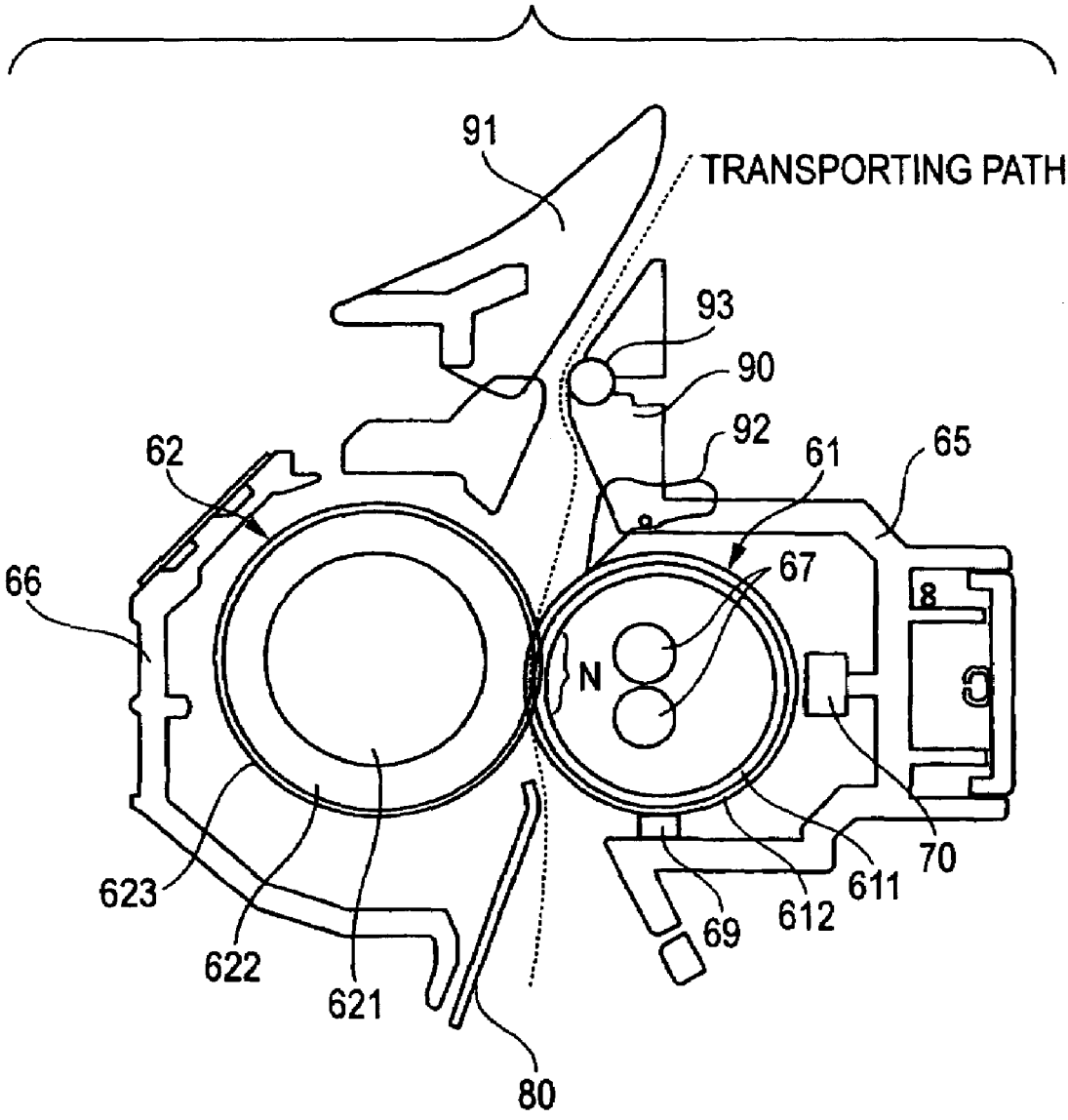
FIG. 2 is a sectional view showing the configuration of a fixing device.

FIG. 2 is a sectional view showing the configuration of the fixing unit 60. As shown in FIG. 2, the fixing unit 60 is unitized by coupling a first casing 65 for rotatably supporting a fixing roll 61 as an example of a heating member and a second casing 66 for rotatably supporting a pressure roll 62 as an example of a pressure member. Further, the unit is mounted so that the line connecting the center of the fixing roll 61 and the center of the pressure roll 62 may be directed substantially in the horizontal direction. The pressure roll 62 is brought into pressure contact with the fixing roll 61 by an elastic body (not shown) including a coil spring or the like, and thereby, a fixing nip N is formed.

The fixing roll 61 includes a cylindrical core 611 and a release layer 612 covering the surface side of the core 611. The core 611 has an outer diameter of 25 mm, for example, and a thickness of 1 to 1.5 mm, for example. A material that forms the core 611 is a metal having high heat conductivity such as iron, aluminum, or SUS, for example. A heat-resistant resin such as silicone resin or fluorocarbon resin is used for the release layer 612, and, in view of releasability and abrasion-resistance to toner, the fluorocarbon resin is appropriate. As the fluorocarbon resin, tetrafluoroethylene perfluoro (alkyl vinyl) ether copolymer (PFA), polytetrafluoroethylene (PTFE), tetrafluoroethylene hexafluoropropylene copolymer (FEP), etc. can be used. The release layer 612 is formed in thickness of 5 to 100 μm, for example.

Further, a halogen heater 67 rated at 600 W, for example, is provided inside of the fixing roll 61 and heats the fixing roll 61. On the surface of the fixing roll 61, a temperature sensor 69 is provided in contact. The controller 40 of the image forming apparatus 1 controls the lighting of the halogen heater 67 based on the measured temperature value by the temperature sensor 69 for adjustment so that the surface temperature of the fixing roll 61 may be maintained at predetermined set temperature (e.g., 175° C.). Further, a thermostat 70 is provided near the fixing roll 61 inside of the first casing 65 and the thermostat 70 prevents the failure due to excessive temperature rise of the fixing roll 61.

The pressure roll 62 includes, for example, a cylindrical solid shaft 621, a heat-resistant elastic material layer 622 provided around the shaft 621, and a release layer 623 covering the surface of the heat-resistant elastic material layer 622. The shaft 621 is made of iron or aluminum, for example, and may be hollow. The heat-resistant elastic material layer 622 is a heat-resistant material having hardness of 45° (Asker C), and formed by a silicon sponge or silicon rubber, for example. Further, the heat-resistant elastic material layer 622 is formed in thickness of 6 mm or more so that a nearly constant nip width may be obtained when the pressure roll 62 is brought into pressure contact with the fixing roll 61. The thickness of the heat-resistant elastic material layer 622 is preferably in a range of 6 to 8 mm. The release layer 623 is formed by PFA having releasability and abrasion resistance to toner, for example. Further, the thickness of the release layer 623 is preferably in a range of 30 to 100 μm.

In directions of upstream side and downstream side with the fixing nip N formed by the fixing roll 61 and the pressure roll 62 in between, the transporting path in which the paper P is transported is formed and the paper P is transported from below upward. At the upstream side (paper feed side) of the fixing nip N, the fixing entry guide 80 made of a plate-like metal that forms the paper transporting system, for example, is provided. Further, at the downstream side (paper ejection side) of the fixing nip N, the paper ejection guides 90 and 91 that form the paper transporting system are disposed. The paper ejection guides 90 and 91 are formed by plural ribs and provided at the first casing 65 side and the second casing 66 side, respectively. Thus, the paper P is passed through between the paper ejection guides 90 and the paper ejection guides 91. Furthermore, on the top of the paper ejection guides 90 at the paper ejection guides 91 side, rotating rolls 93 are provided so that fuzz may not be produced in the paper P when it passes through between the paper ejection guides 90 and the paper ejection guides 91, and thereby, smooth transportation is realized.

Further, plural detachment claws 92 as detaching members are provided to the first casing 65 in the vicinity of the downstream side of the fixing nip N in the axis direction of the fixing roll 61 (width direction of paper). This detachment claw 92 is urged toward the fixing roll 61 side by so weak a force not to scratch the surface of the fixing roll 61. The tip ends of the detachment claws 92 are brought into pressure contact with the surface of the fixing roll 61 for detaching the paper that tends to wrap around the fixing roll 61.

Figure 3:
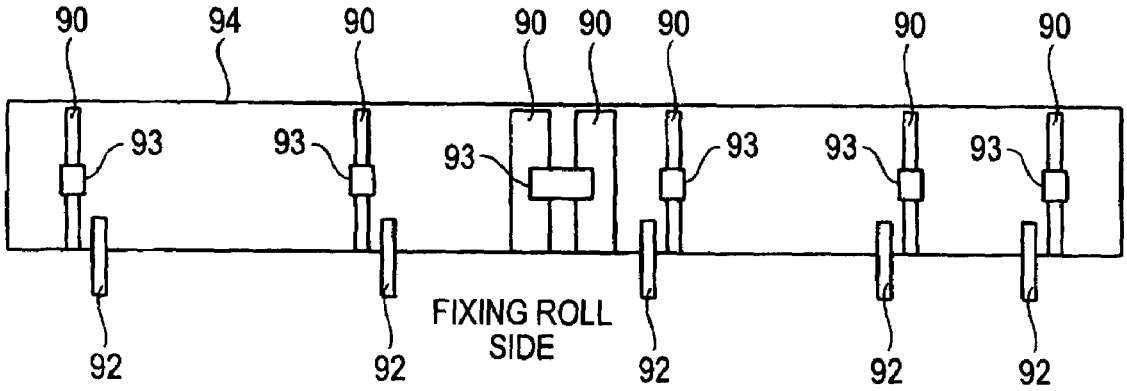
FIG. 3 shows an arrangement in a width direction in which paper ejection guides and detachment claws are set.

Here, FIG. 3 shows an arrangement in the width direction in which the paper ejection guides 90 and the detachment claws 92 are set. As shown in FIG. 3, the paper ejection guides 90 and the detachment claws 92 are arranged substantially alternately at predetermined intervals on a paper ejection guide holder 94. Further, the rotating rolls 93 are provided on the top of the paper ejection guides 90. By such a configuration, the paper P that has passed through the fixing nip N is fed to the ejected paper receiving part 58.

Next, an arrangement of the respective component elements around the transporting path will be described.

Figure 4:
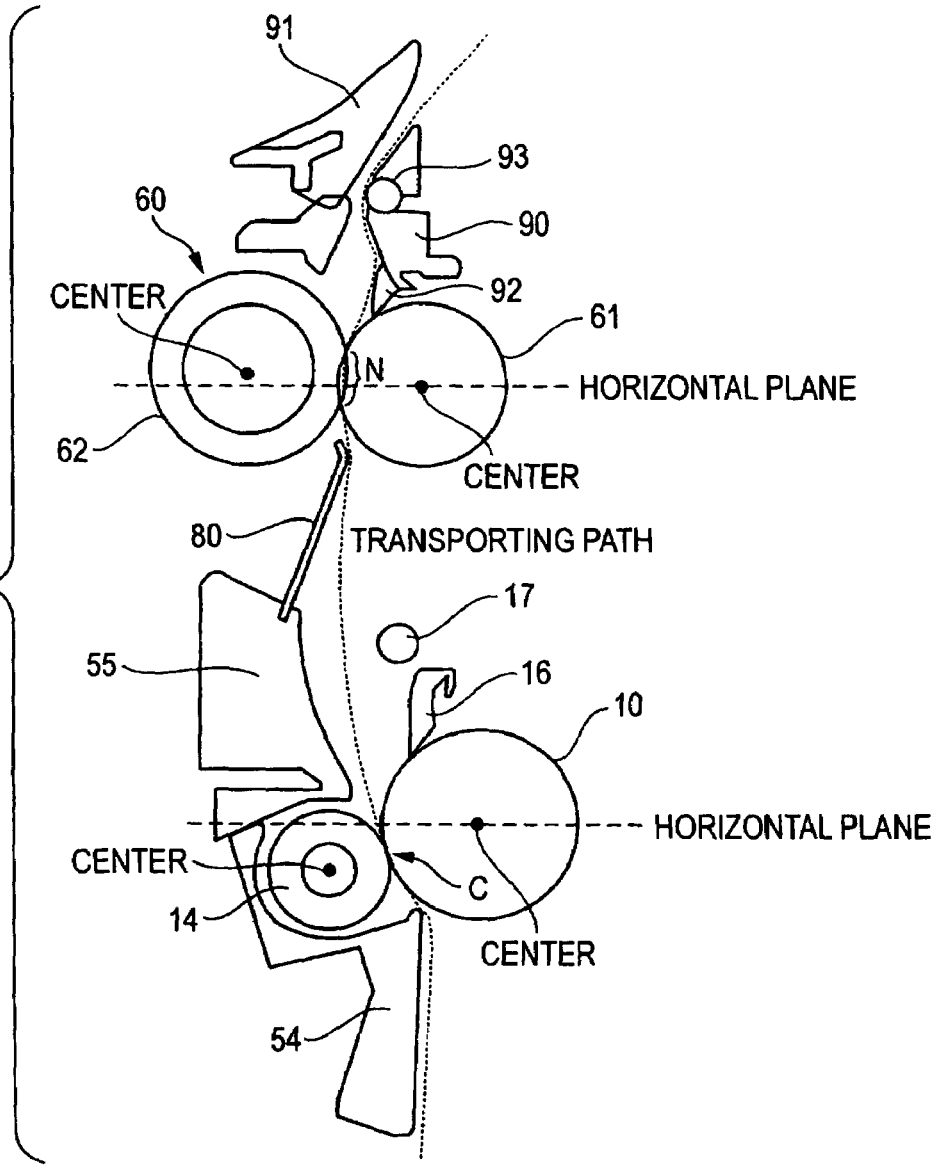
FIG. 4 is a diagram for explanation of an arrangement of the component elements around the transporting path.

FIG. 4 is a diagram for explanation of the arrangement of the component elements around the transporting path. First, using FIG. 4, the positional relationship between the transfer roll 14 and the photoconductor drum 10 will be described. In the image forming apparatus 1 of the embodiment, the transporting path in which the paper P is transported is formed from below upward substantially in the vertical direction. When the paper P is ejected at a tilt toward the photoconductor drum 10 side relative to the vertical direction at the exit (downstream side) of the transfer nip C as a contact portion of the photoconductor drum 10 and the transfer roll 14, the paper P is transported with the surface on which the toner image has been transferred tilted toward the photoconductor drum 10. In this case, the toner image and the members provided in the image forming apparatus 1 are in contact with each other, and the toner image is disturbed and causes image defects. Accordingly, as shown in FIG. 4, the position where the transfer roll 14 contacts the photoconductor drum 10 is set so as to be slightly below the horizontal plane that passes through the center of the photoconductor drum 10. By the arrangement, the paper P that has passed through the transfer nip C is ejected at a tilt toward the transfer roll 14 side relative to the vertical direction, and thereby, the toner image on the paper P is prevented from contacting the members.

Subsequently, the positional relationship between the fixing roll 61 and the pressure roll 62 in the fixing unit 60 will be described. In the fixing unit 60, as described above, they are mounted to the image forming apparatus 1 so that the line connecting the center of the fixing roll 61 and the center of the pressure roll 62 may be directed substantially in the horizontal direction. However, when the paper P that has been ejected from the fixing unit 60 passes through between the paper ejection guides 90 and the paper ejection guides 91 and is transported to the ejected paper receiving part 58, in the case where the radius of curvature of the transporting path formed between the paper ejection guides 90 and the paper ejection guides 91 is small (the curve is sharp), the paper P immediately after heated by the fixing unit 60 is likely to be curled. Accordingly, as shown in FIG. 4, in the fixing unit 60, the pressure roll 62 side is disposed slightly above the horizontal plane that passes through the center of the fixing roll 61. By the arrangement, since the paper P that has passed through the fixing nip N of the fixing unit 60 is ejected at a tilt toward the fixing roll 61 side, i.e., the ejected paper receiving part 58 side relative to the vertical direction, the radius of curvature of the transporting path between the paper ejection guides 90 and the paper ejection guides 91 can be formed larger, and thereby, the paper P is prevented from being curled.

Furthermore, the positional relationship in the horizontal direction between the transfer nip C formed by the photoconductor drum 10 and the transfer roll 14 and the fixing nip N at which the fixing roll 61 and the pressure roll 62 are brought into pressure contact in the fixing unit 60 will be described. In the horizontal direction, if the fixing nip N is located at the photoconductor drum 10 side beyond the transfer nip C, when the paper P that has passed through the transfer nip C is transported to the fixing unit 60, the paper P is required to be rapidly tilted toward the fixing nip N side. Accordingly, the arrangement is not preferable because the paper P becomes easier to contact the photoconductor drum 10. On the other hand, in the horizontal direction, if the fixing nip N is located apart the transfer nip C toward the transfer roll 14 direction, a unit for transporting the paper P while attracting the paper P toward the transfer roll 14 side is required for stably transporting the paper P. Further, in this case, the installation area of the image forming apparatus 1 becomes larger. In view of the points, the position of the fixing nip N in the horizontal direction may be a position where it overlaps the position of the transfer nip C, or a position slightly displaced toward the transfer roll 14 from the position of the transfer nip C.

By the arrangement of the photoconductor drum 10 and the transfer roll 14, and further, the arrangement of the fixing roll 61 and the pressure roll 62 in the fixing unit 60, in the transporting path between the transfer nip C and the fixing nip N, at the exit side of the transfer nip C, the paper P is transported at a tilt apart from the photoconductor drum 10, and the fixing unit 60 to which paper is fed at a tilt toward the photoconductor drum 10 side receives the paper. By such an arrangement, as shown in FIG. 4, the paper P is transported while depicting a gentle curve with a convex shape toward the transfer roll 14 side (the pressure roll 62 side) from the vertical direction in the transporting path between the transfer nip C and the fixing nip N, and the surface of the paper P on the side carrying the toner image becomes hard to be in contact with the member disposed around the transporting path.

Especially, in the image forming apparatus 1 of the embodiment, since the length between the transfer nip C and the fixing nip N is shorter than the longitudinal length of the paper P of A4 size, for example, the paper P is simultaneously nipped by both the transfer nip C and the fixing nip N. Accordingly, in order not to produce transfer misalignment because the portion nipped by the transfer nip C is pulled by the portion nipped by the fixing nip N, the transfer speed at the fixing unit 60 is made slightly slower than the transfer speed at the transfer nip C. Thereby, slight slack is produced in the transporting path between the transfer nip C and the fixing nip N. Accordingly, it is desired that, in order to make it hard to contact between the paper P and the members disposed around the transporting path, the paper P is transported while depicting a curve like a convex shape toward the transfer roll 14 side (the pressure roll 62 side) from the vertical direction in the transporting path between the transfer nip C and the fixing nip N as described above.

Next, a transporting path used when the paper P that has been fixed in the fixing unit 60 is ejected from the fixing unit 60 after the paper is transported from the transfer nip C to the fixing unit 60 by the above described transporting path will be described.

Figure 5:
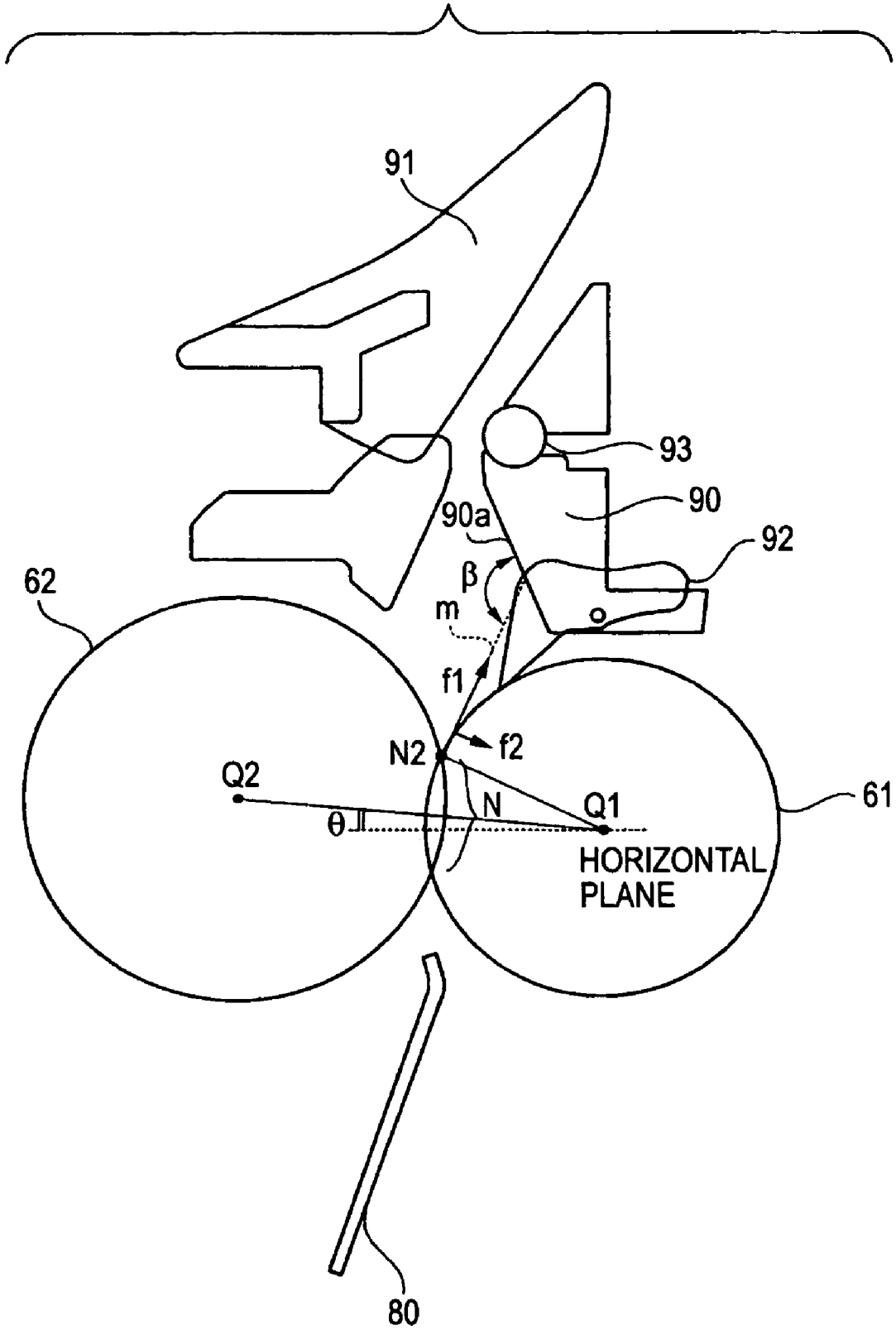
FIG. 5 is a diagram for explanation of the paper ejection guides disposed at the paper ejection side of the fixing unit.

FIG. 5 is a diagram for explanation of the paper ejection guides 90 disposed at the paper ejection side of the fixing unit 60. As described above, the paper ejection guides 90 and 91 formed by ribs and the detachment claws 92 are arranged at the paper ejection side of the fixing unit 60. The paper P that has been ejected from the fixing unit 60 is guided between the paper ejection guides 90 and the paper ejection guides 91, and transported to the ejected paper receiving part 58 provided at the eject part of the image forming apparatus 1 (also see FIG. 1). At this time, in the paper ejection guides 90 of the embodiment, in order to suppress occurrence of wavy wrinkles (so-called "paper cockles") formed in the traveling direction and bending and folding of both of the lead edges (so-called "dog-ears") in the paper P ejected from the fixing unit 60, as shown in FIG. 5, paper ejection guide surfaces 90*a* at the transporting path side of the paper ejection guides 90 are formed so as to intersect the tangential line m of the fixing roll 61 surface at the exit point N2 of the fixing nip N at an intersecting angle β as an obtuse angle in the vicinity of the fixing roll 61.

Here, occurrence of cockles in the paper P ejected from the fixing unit 60 will be described. First, on the paper P being ejected from the fixing unit 60, a force f1 for pushing out in the tangential line m direction of the fixing roll 61 surface at the exit point N2 of the fixing nip N strongly is exerted by the fixing roll 61 and pressure roll 62 rotating in pressure contact. This is a phenomenon that has been demonstrated by experiments, and the phenomenon is thought to occur as a result of the balance of the force between the attraction force to the fixing roll 61 and the attraction force to the pressure roll 62 in the paper P because the fixing roll 61 and the pressure roll 62 rotate in pressure contact in the fixing nip N. Further, since the toner image is carried on the surface of the paper P at the fixing roll 61 side, an adhesive force acts between the toner image and the fixing roll 61 surface. Thereby, a force f2 toward the fixing roll 61 surface side also acts on the paper P. Since the force f2 toward the fixing roll 61 surface is the adhesive force between the toner image and the fixing roll 61 surface, the force also changes depending on the area ratio occupied by the toner image on the surface of the paper P. Note that, since the direction of the gravitational force is nearly opposite direction to the transporting direction of the paper P, the effect by the gravitational force exerted on the paper P is extremely small.

In a state in which such a force is exerted, as a force acting on the paper P ejected from the fixing unit 60, the force f1 by which the paper is pushed out from the fixing nip N is principal, however, the force f2 that changes depending on the area of toner image acts toward the fixing roll 61 surface side, and the traveling direction of the paper P swings from the tangential line m direction of the fixing roll 61 surface toward the fixing roll 61 surface side. Specifically, in a state in which the force f2 toward the fixing roll 61 surface side is relatively strong, the paper P is directed toward the fixing roll 61 surface side, while, in a state in which the force f2 toward the fixing roll 61 surface side is relatively weak, the paper P is directed toward the tangential line m direction. Cockles are considered to occur in the paper P because such movement is produced unstably.

Accordingly, in the paper ejection guides 90 of the embodiment, the paper ejection guide surfaces 90*a* at the transporting path side of the paper ejection guides 90 are formed so as to intersect the tangential line m of the fixing roll 61 surface at the exit point N2 of the fixing nip N at an intersecting angle β as an obtuse angle in the vicinity of the fixing roll 61.

Figure 6:
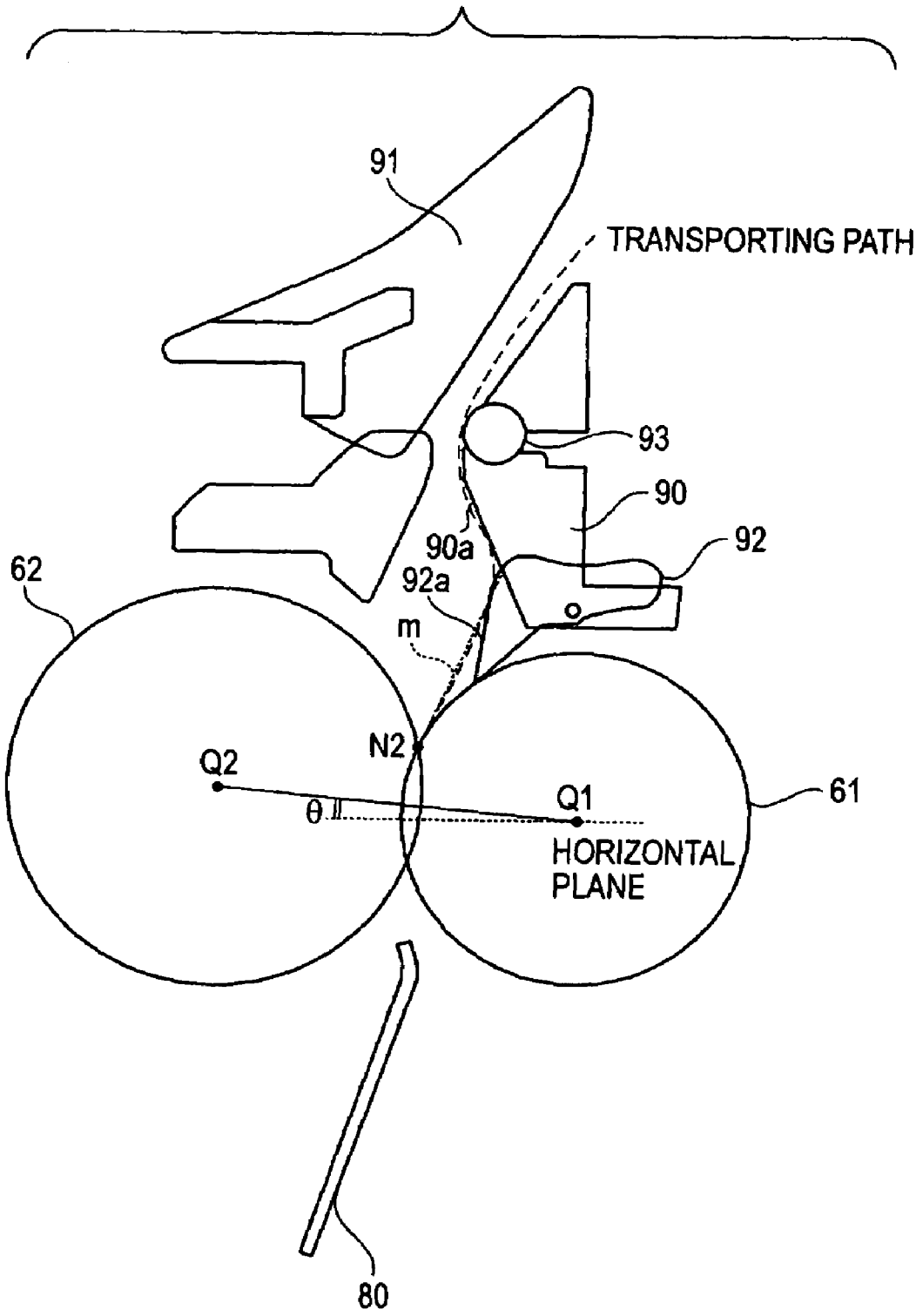
FIG. 6 is a diagram for explanation of a transporting path when the paper P after fixing is ejected from the fixing unit.

As described above, in the fixing unit 60, the center Q2 of the pressure roll 62 is located above the horizontal plane that passes through the center Q1 of the fixing roll 61 by an angle θ (θ>0). Thereby, the tangential line m of the fixing roll 61 surface at the exit point N2 of the fixing nip N is set at a tilt toward the fixing roll 61. Accordingly, when the paper ejection guides 90 are arranged in the vicinity of the fixing roll 61 and the paper ejection guide surfaces 90*a* intersecting the tangential line m of the fixing roll 61 surface at the intersecting angle β as an obtuse angle are formed, the force f1 for pushing out in the tangential line m direction strongly acting on the paper P ejected from the fixing unit 60 strongly pushes the paper P against the paper ejection guide surfaces 90*a*. Thereby, the paper P ejected from the fixing unit 60 is transported through the curved transporting path like a convex shape toward detachment guide surfaces 92*a* at the pressure roll 62 side of the detachment claws 92 and the paper ejection guide surfaces 90*a* of the paper ejection guides 90 as shown in FIG. 6, while being strongly supported by both the fixing nip N and the paper ejection guide surfaces 90*a*.

Thus, since the paper P ejected from the fixing unit 60 is strongly supported by both the fixing nip N and the paper ejection guide surfaces 90*a* of the paper ejection guides 90, even if the force f2 toward the fixing roll 61 surface side acts when the paper P is ejected from the fixing unit 60, a force counteracting the force f2 is produced in the paper P by the supporting force at the fixing nip N and a reaction force from the paper ejection guide surfaces 90*a*. Accordingly, the swing in the traveling direction of the paper P from the tangential line m direction of the fixing roll 61 toward the fixing roll 61 surface side is stably suppressed and occurrence of cockles in the paper P is suppressed.

Further, since the intersecting angle β between the tangential line m and the paper ejection guide surfaces 90*a* of the paper ejection guides 90 is an obtuse angle, the paper P after coming into contact with the paper ejection guide surfaces 90*a* of the paper ejection guides 90 is transported smoothly on the paper ejection guide surfaces 90*a*. Accordingly, since unwanted force that inhibits the traveling never acts on the lead edge of the paper P, occurrence of dog-ears is also suppressed at both ends of the lead edges of the paper P.

By the way, in such an arrangement, when the force f1 for pushing out in the tangential line m direction strongly pushes the paper P against the paper ejection guide surfaces 90*a* of the paper ejection guides 90, what transmits the force f1 for pushing out in the tangential line m direction to the paper ejection guide surfaces 90*a* is the rigidity of the paper P (so-called "stiffness"). Accordingly, in order to strongly maintain the rigidity of the paper P, the distance between the exit point N2 of the fixing nip N and the paper ejection guide surfaces 90*a* may be set shorter. On this account, the paper ejection guide surfaces 90*a* of the paper ejection guides 90 are located in the vicinity of the fixing roll 61. Specifically, the paper ejection guide surfaces 90*a* are set so that the intersection point with the tangential line m may be located at the pressure roll 62 side of the vertical line that passes through the center Q1 of the fixing roll 61.

Subsequently, the setting angle (tilt angle) of the detachment guide surfaces 92*a* formed at the pressure roll 62 side of the detachment claws 92 will be described.

Figure 7:
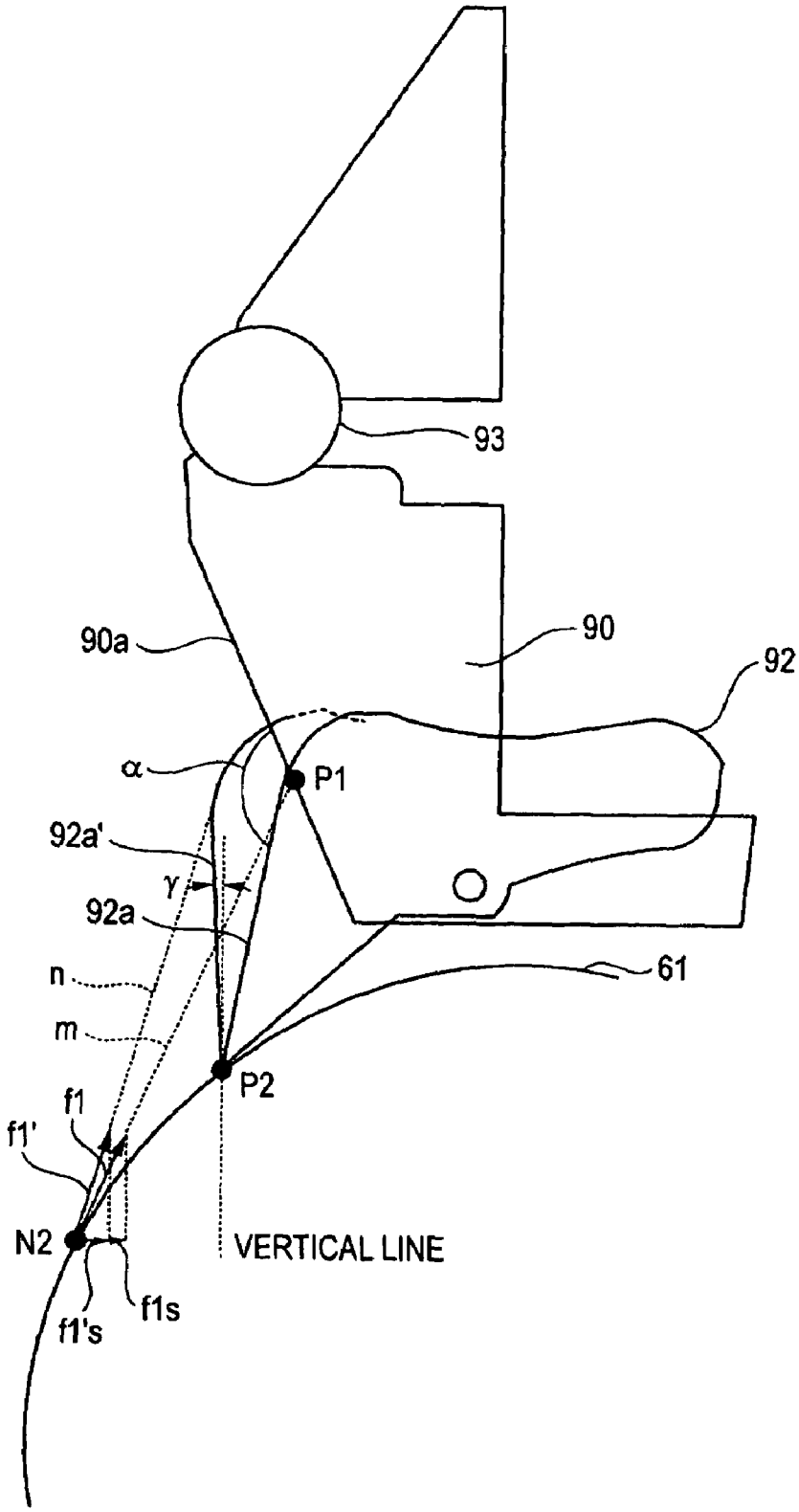
FIG. 7 is a diagram for explanation of a range of set angle of the detachment guide surface of the detachment claw.

FIG. 7 is a diagram for explanation of a range of tilt angle of the detachment guide surfaces 92*a* of the detachment claws 92. As described above, since the force f1 for pushing out in the tangential line m direction acts on the paper P ejected from the fixing unit 60 and strongly pushes the paper P against the paper ejection guide surfaces 90*a* of the paper ejection guides 90, the paper P ejected from the fixing unit 60 is strongly supported by both the fixing nip N and the paper ejection guide surfaces 90*a*. Then, the paper P is transported through the transporting path along part of the detachment guide surfaces 92*a* of the detachment claws 92 and the paper ejection guide surfaces 90*a* while being strongly supported by both the fixing nip N and the paper ejection guide surfaces 90*a*. Thereby, paper cockles are suppressed. Therefore, the detachment guide surfaces 92*a* of the detachment claws 92 are required to be set so that the force f1 for pushing out in the tangential line m direction may be efficiently transmitted to the paper ejection guide surfaces 90*a* via the paper P.

Here, the case where the detachment guide surfaces 92*a* of the detachment claws 92 are formed at the pressure roll 62 side (the case where they are set to detachment guide surfaces 92*a*' in the drawing) is assumed. In this case, the transporting path of the paper P moves above the tangential line m in the vertical direction by the detachment guide surfaces 92*a* of the detachment claws 92 and comes along the path n in the drawing. Then, the force f1 from the exit point N2 of the fixing nip N toward the intersection point P1 of the tangential line m and the paper ejection guide surfaces 90*a* moves in the direction of the path n and changes into a force f1' toward the direction along the path n. In this case, since the component f1's of the force f1' toward the paper ejection guides 90 side becomes smaller than the component f1*s* of the force f1 along the tangential line m toward the paper ejection guides 90 side, the force by which the paper is pushed against the paper ejection guide surfaces 90*a* of the paper ejection guides 90 is reduced. Thereby, the paper P ejected from the fixing unit 60 can not be supported by both the fixing nip N and the paper ejection guide surfaces 90*a*, and the effect that the occurrence of cockles in the paper P is suppressed can not be obtained sufficiently. Accordingly, the detachment guide surfaces 92*a* of the detachment claws 92 are required to be set in a range of predetermined angle (tilt angle) at the fixing roll 61 side with the point P2 where the detachment claws 92 contact the fixing roll 61 as a reference point.

In order to sufficiently suppress the occurrence of cockles in the paper P, an experiment is conducted for finding out the tilt angle of the detachment guide surfaces 92*a* at which the force f1 for pushing out in the tangential line m direction is efficiently transmitted to the paper ejection guide surfaces 90*a* via the paper P. Here, assuming that the angle (tilt angle) formed by the detachment guide surfaces 92*a* of the detachment claws 92 with the vertical line at the contact point P2 of the detachment claws 92 and the fixing roll 61 is γ, the occurrence of cockles in the paper P is observed while changing the tilt angle γ of the detachment guide surfaces 92*a*. Note that the tilt angle γ is positive toward the clockwise direction (fixing roll 61 side).

The result is shown in FIG. 8. As shown in FIG. 8, when the tilt angle γ is smaller than −2.5° (tilted toward the pressure roll 62 more than 2.5° relative to the vertical line), because the force for pushing the paper P against the paper ejection guide surfaces 90*a* of the paper ejection guides 90 is reduced, cockles occur in the paper P. Contrary, when the tilt angle γ is equal to or larger than −2.5° (greatly tilted toward the fixing roll 61 side than the position where tilted toward the pressure roll 62 by −2.5° relative to the vertical line), the force for pushing the paper P against the paper ejection guide surfaces 90*a* of the paper ejection guides 90 is sufficiently obtained, occurrence of cockles in the paper P can be suppressed.

Thus, as the tilt angle of the detachment guide surfaces 92*a* of the detachment claws 92, by setting the tilt angle γ formed with the vertical line at the contact point P2 of the detachment claws 92 and the fixing roll 61 as γ≧−2.5°, the force f1 for pushing out in the tangential line m direction is efficiently transmitted to the paper ejection guide surfaces 90*a* via the paper P. Thereby, since the paper P ejected from the fixing unit 60 is strongly supported by both the fixing nip N and the paper ejection guide surfaces 90*a* of the paper ejection guides 90, the curved transporting path like a convex shape toward detachment guide surfaces 92*a* at the pressure roll 62 side of the detachment claws 92 and the paper ejection guide surfaces 90*a* of the paper ejection guides 90 is formed, and occurrence of cockles in the paper P can be suppressed.

Further, on the other hand, the angle α formed by the detachment guide surfaces 92*a* of the detachment claws 92 and the paper ejection guide surfaces 90*a* of the paper ejection guides 90 is preferably an obtuse angle (α>90°). By forming the angle α between the detachment guide surfaces 92*a* and the paper ejection guide surfaces 90*a*, the transportation of the paper P from the detachment guide surfaces 92*a* to the paper ejection guide surfaces 90*a* is performed smoothly, and the occurrence of dog-ears can be suppressed.

As described above, in the image forming apparatus 1 of the embodiment, the detachment guide surfaces 92*a* of the detachment claws 92 are set so that the tilt angle γ formed with the vertical line at the contact point P2 of the detachment claws 92 and the fixing roll 61 may be γ≧−2.5°. By the configuration, since the paper P ejected from the fixing unit 60 is strongly supported by the fixing nip N and the paper ejection guide surfaces 90*a* of the paper ejection guides 90, even if the force f2 toward the fixing roll 61 surface side acts when the paper P is ejected from the fixing unit 60, a sufficient force counteracting the force f2 is produced in the paper P by the supporting force at the fixing nip N and a reaction force from the paper ejection guide surfaces 90*a* of the paper ejection guides 90. Thereby, the swing in the traveling direction of the paper P from the tangential line m direction of the fixing roll 61 surface toward the fixing roll 61 surface side is stably suppressed and determined constant, and occurrence of cockles in the paper P is suppressed.

In addition, in the detachment claws 92, the angle α formed by the detachment guide surfaces 92*a* and the paper ejection guide surfaces 90*a* of the paper ejection guides 90 is set to an obtuse angle (α>90°). Thereby, the transportation of the paper P from the detachment guide surfaces 92*a* of the detachment claws 92 to the paper ejection guide surfaces 90*a* of the paper ejection guides 90 is performed smoothly, and the occurrence of dog-ears can be suppressed.

The invention can be applied to copiers, printers, facsimiles using electrophotographic system, and further, multifunction machines having these functions.

As described above, some aspects of the invention are outlined below.

According to an aspect of the invention, an image forming apparatus includes a recording material transporting path that extends in a direction from below upward and that transports a recording material, a fixing device provided on the way of the recording material transporting path, the fixing device includes a rotatable heating member that has a heating source provided inside thereof, and a rotatable pressure member that forms a fixing nip in pressure contact with the heating member, and a detaching member that contacts the heating member in the vicinity at a downstream side of the of the fixing nip in the rotation direction of the heating member and detaches the recording material from the heating member. The detachment member has a detachment guide surface extending from a contact point with the heating member, and a tilt of the detachment guide surface toward the pressure member side in relation with a vertical line including the contact point is not more than 2.5°.

Here, an image forming apparatus according to another aspect of the invention further includes a paper ejection guiding member having a paper ejection guide surface that guides the recording material ejected from the fixing nip between the heating member and the pressure member to the outside of the apparatus, wherein the detachment guide surface of the detaching member is formed along a direction intersecting the paper ejection guide surface at an obtuse angle. Especially, in an image forming apparatus according to another aspect of the invention, the paper ejection guide surface of the paper ejection guiding member may intersect a tangential line of the heating member at the lowermost stream point of the fixing nip and the intersecting angle with the tangential line may be an obtuse angle. Furthermore, in an image forming apparatus according to another aspect of the invention, each of the detaching member and the paper ejection guiding member may include ribs. Further, in an image forming apparatus according to another aspect of the invention, the detachment guide surface of the detaching member may support the recording material. In addition, in an image forming apparatus according to another aspect of the invention, a center of the pressure member is disposed above a horizontal plane including a center of the heating member.

Further, according to another aspect of the invention, an image forming apparatus includes a recording material transporting path that extends in a direction from below upward and that transports a recording material, a fixing device provided on the way of the recording material transporting path, the fixing device including a rotatable fixing roll that has a heating source provided inside thereof, and a rotatable pressure roll a center of which is disposed above a horizontal plane including a center of the fixing roll, the pressure roll forming a fixing nip in pressure contact with the heating member, a detaching member that contacts the fixing roll in the vicinity at a downstream side of the of the fixing nip in the rotation direction of the fixing roll and detaches the recording material from the heating member, the detachment member having a detachment guide surface extending from a contact point with the fixing roll, and a tilt of the detachment guide surface toward the pressure roll side in relation with a vertical line including the contact point is not more than 2.5°, and a paper ejection guiding member having a paper ejection guide surface that guides the recording material at a downstream side of the detaching member in a transporting direction of the recording material to the outside of the image forming apparatus Here, in an image forming apparatus according to another aspect of the invention, the detachment guide surface of the detaching member and the paper ejection guide surface of the paper ejection guiding member may guide the recording material while being pushed by the recording material that has passed through the fixing nip. Further, in an image forming apparatus according to another aspect of the invention, the detachment guide surface of the detaching member and the paper ejection guide surface of the paper ejection guiding member may form a curved surface having substantially a convex shape toward the fixing roll side relative to the vertical direction. Furthermore, in an image forming apparatus according to another aspect of the invention, the paper ejection guide surface of the paper ejection guiding member may intersect a tangential line of the fixing roll at the lowermost stream point of the fixing nip at an obtuse tangle and intersect the detachment guide surface of the detaching member at an obtuse angle.

According to an aspect of the invention, in an image forming apparatus in which a fixing unit is provided in a position where the recording material is transported from below upward against gravitational force, occurrence of paper cockles and dog-ears in the recording material can be suppressed. Thereby, the flatness of the recording material after fixation can be maintained and a high quality fixing image can be formed.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-320993 filed on Nov. 4, 2004 including specification, claims, drawings and abstract is incorporated herein by reference in its entirety.

What is claimed is:

1. An image forming apparatus comprising:

a recording material transporting path that extends in a direction from below upward and that transports a recording material;

a fixing device provided on the way of the recording material transporting path, the fixing device comprising:

a rotatable heating member that has a heating source provided inside thereof; and a rotatable pressure member that forms a fixing nip in pressure contact with the heating member; and a detaching member that contacts the heating member in the vicinity at a downstream side of the of the fixing nip in the rotation direction of the heating member and detaches the recording material from the heating member, wherein the detachment member has a detachment guide surface extending from a contact point with the heating member, and a tilt of the detachment guide surface toward the pressure member side in relation with a vertical line including the contact point is not more than 2.5°.

2. The image forming apparatus according to claim 1, further comprising a paper ejection guiding member having a paper ejection guide surface that guides the recording material ejected from the fixing nip between the heating member and the pressure member to the outside of the image forming apparatus, wherein the detachment guide surface of the detaching member is formed along a direction intersecting the paper ejection guide surface at an obtuse angle.

3. The image forming apparatus according to claim 2, wherein the paper ejection guide surface of the paper ejection guiding member intersects a tangential line of the heating member at the lowermost stream point of the fixing nip and the intersecting angle with the tangential line is an obtuse angle.

4. The image forming apparatus according to claim 2, wherein each of the detaching member and the paper ejection guiding member includes a plurality of ribs.

5. The image forming apparatus according to claim 1, wherein the detachment guide surface of the detaching member supports the recording material.

6. The image forming apparatus according to claim 1, wherein a center of the pressure member is disposed above a horizontal plane including a center of the heating member.

7. An image forming apparatus comprising:

a recording material transporting path that extends in a direction from below upward and that transports a recording material;

a fixing device provided on the way of the recording material transporting path, the fixing device comprising:

a rotatable fixing roll that has a heating source provided inside thereof; and a rotatable pressure roll a center of which is disposed above a horizontal plane including a center of the fixing roll, the pressure roll forming a fixing nip in pressure contact with the fixing roll;

a detaching member that contacts the fixing roll in the vicinity at a downstream side of the of the fixing nip in the rotation direction of the fixing roll and detaches the recording material from the fixing roll, the detachment member having a detachment guide surface extending from a contact point with the fixing roll, and a tilt of the detachment guide surface toward the pressure roll side in relation with a vertical line including the contact point is not more than 2.5°; and a paper ejection guiding member having a paper ejection guide surface that guides the recording material at a downstream side of the detaching member in a transporting direction of the recording material to the outside of the image forming apparatus.

8. The image forming apparatus according to claim 7, wherein the detachment guide surface of the detaching member and the paper ejection guide surface of the paper ejection guiding member guide the recording material while being pushed by the recording material that has passed through the fixing nip.

9. The image forming apparatus according to claim 7, wherein the detachment guide surface of the detaching member and the paper ejection guide surface of the paper ejection guiding member form a curved surface having substantially a convex shape toward the fixing roll side.

10. The image forming apparatus according to claim 7, wherein the paper ejection guide surface of the paper ejection guiding member intersects a tangential line of the fixing roll at the lowermost stream point of the fixing nip at an obtuse angle and intersects the detachment guide surface of the detaching member at an obtuse angle.

* * * * *